US008436736B2

(12) United States Patent
Tsai

(10) Patent No.: US 8,436,736 B2
(45) Date of Patent: May 7, 2013

(54) TEMPERATURE MONITORING SYSTEM AND METHOD

(75) Inventor: Ying-Chuan Tsai, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 213 days.

(21) Appl. No.: 13/155,306

(22) Filed: Jun. 7, 2011

(65) Prior Publication Data

US 2012/0086572 A1 Apr. 12, 2012

(30) Foreign Application Priority Data

Oct. 7, 2010 (TW) ..... 99134276 A

(51) Int. Cl.
*G08B 23/00* (2006.01)

(52) U.S. Cl.
USPC ..... 340/573.1; 340/584; 382/224; 382/190; 382/141; 348/164

(58) Field of Classification Search ..... 340/573.1, 340/584, 583; 382/104, 190, 141, 224; 348/148, 348/164; 702/152, 41
See application file for complete search history.

(56) References Cited

U.S. PATENT DOCUMENTS

| | | | | |
|---|---|---|---|---|
| 7,957,931 | B2 * | 6/2011 | Nilsagard et al. | 702/152 |
| 2002/0051578 | A1 * | 5/2002 | Imagawa et al. | 382/224 |
| 2006/0262971 | A1 * | 11/2006 | Foes et al. | 382/141 |
| 2007/0087311 | A1 * | 4/2007 | Garvey et al. | 434/21 |
| 2007/0177014 | A1 * | 8/2007 | Frenzel et al. | 348/148 |
| 2008/0199045 | A1 * | 8/2008 | Ekin | 382/104 |
| 2009/0177416 | A1 * | 7/2009 | Nilsagard et al. | 702/41 |
| 2009/0216130 | A1 * | 8/2009 | Hirsch et al. | 600/474 |
| 2011/0028788 | A1 * | 2/2011 | Oral et al. | 600/182 |
| 2011/0166694 | A1 * | 7/2011 | Griffits et al. | 700/215 |
| 2011/0306877 | A1 * | 12/2011 | Dvorsky et al. | 600/431 |
| 2012/0050539 | A1 * | 3/2012 | Naimi et al. | 348/164 |
| 2012/0086572 | A1 * | 4/2012 | Tsai | 340/573.1 |
| 2012/0189206 | A1 * | 7/2012 | Iketani | 382/190 |

* cited by examiner

*Primary Examiner* — Hoi Lau
(74) *Attorney, Agent, or Firm* — Altis Law Group, Inc.

(57) ABSTRACT

A microcontroller receives color codes of pixel points in an image captured by an infrared camera. If there is a color code falling within a color code range corresponding to a warning temperature range, the microcontroller determines a location of the pixel point of the image corresponding to the color code. A block of a monitored area of the image corresponding to the location is determined. An alarm is activated and an LED (light-emitting diode) is controlled to point at the determined block to let monitoring people know which person object has an inappropriately high temperature.

15 Claims, 3 Drawing Sheets

TEMPERATURE MONITORING SYSTEM AND METHOD

BACKGROUND

1. Technical Field

Embodiments of the present disclosure relate to temperature management systems and methods, particularly to a temperature monitoring system and method.

2. Description of Related Art

In a monitored area, such as airports or workshops, it is necessary to monitor the temperature of people and objects. Generally, an infrared camera is used to capture images of the monitored area and send the images to a computer. A monitoring person analyzes the images and determines if there are any people or objects with an inappropriately high temperature. However, the people or objects with inappropriately high temperature may be omitted if the monitoring person is careless.

DETAILED DESCRIPTION

The disclosure is illustrated by way of examples and not by way of limitation in the figures of the accompanying drawings in which like references indicate similar elements. It should be noted that references to "an" or "one" embodiment in this disclosure are not necessarily to the same embodiment, and such references mean at least one.

In general, the word "module," as used hereinafter, refers to logic embodied in hardware or firmware, or to a collection of software instructions, written in a programming language, such as, for example, Java, C, or Assembly. One or more software instructions in the modules may be embedded in firmware. It will be appreciated that modules may comprised connected logic units, such as gates and flip-flops, and may comprise programmable units, such as programmable gate arrays or processors. The modules described herein may be implemented as either software and/or hardware modules and may be stored in any type of computer-readable medium or other computer storage device.

Figure 1:
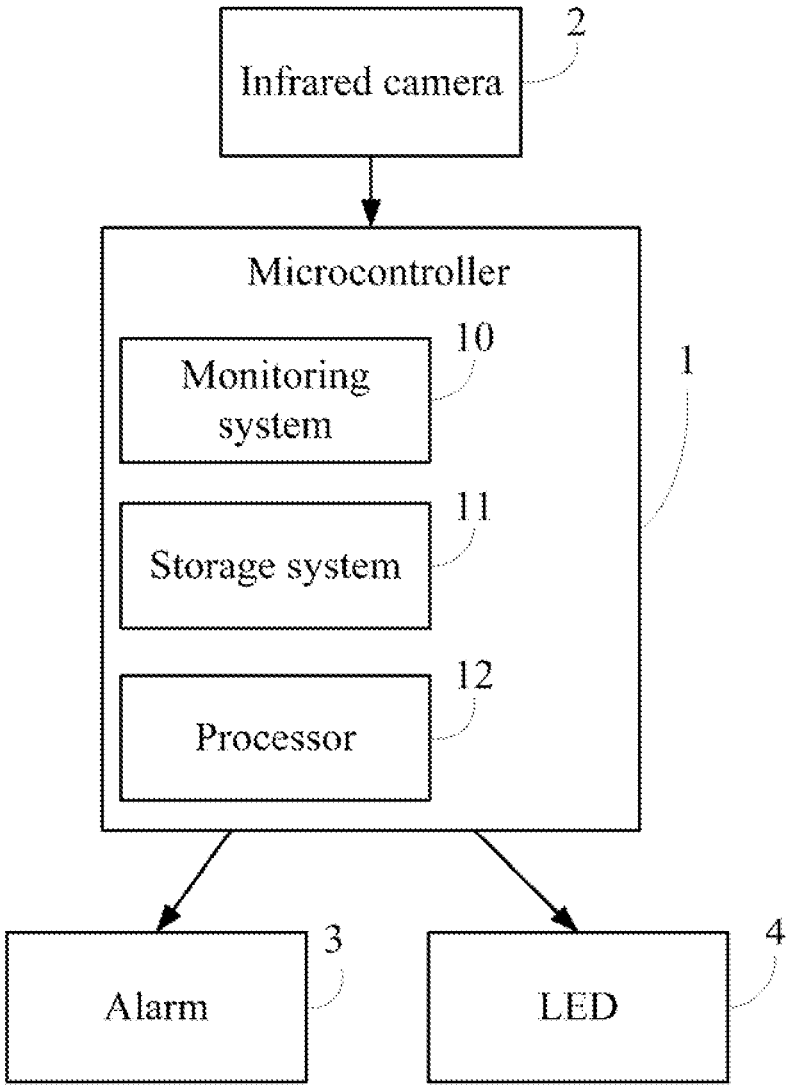
FIG. 1 is a block diagram of one embodiment of a microcontroller comprising a monitoring system.

FIG. 1 is a block diagram of one embodiment of a microcontroller 1 comprising a monitoring system 10. The monitoring system 10 may be used to monitor a monitored area to detect if there are any people or objects with an inappropriately high temperature in the monitored area. The microcontroller 1 connects with an infrared camera 2. The infrared camera 2 captures images of the monitored area. In one embodiment, the images may be monochrome. Each image includes a plurality of pixel points. The infrared camera 2 generates a color code for each pixel point. For example, color code of a pixel point is FFFFFF. The infrared camera 2 sends the color code to the microcontroller 1. The color codes of all the pixels in each image are sent in sequence. In one embodiment, an image may have a resolution of 100 pixels×100 pixels, the sequence of sending may be from a color code of the top leftmost pixel in the image to a color code of the pixel on the right, and repeat for each line of pixels until the color code of the bottommost pixel on the right has been sent.

The microcontroller 1 includes a storage system 11. The storage system 11 stores a color code range corresponding to a warning temperature range. For example, if the warning temperature range is greater than 37 centigrade, then the color code range corresponding to the warning temperature range is greater than FFEECC. The microcontroller 1 detects if any color codes sent from the infrared camera 2 fall within the color code range. If there are any color codes of pixel points sent from the infrared camera 2 falling within the color code range, the microcontroller 1 determines that people or objects corresponding to the pixel points in the image are in inappropriately high temperature.

The microcontroller 1 includes an alarm 3 and an LED (light-emitting diode) 4. If there are some people or objects with inappropriately high temperature are determined, the alarm 3 generates a warning signal. The LED 4 points out the people or objects to let monitoring people to know which person or object is in inappropriately high temperature.

In an exemplary embodiment, the microcontroller 1 includes at least one processor 12. The monitoring system 10 may include one or more modules. The one or more modules may comprise computerized code in the form of one or more programs that are stored in the storage system 11 (or memory). The computerized code includes instructions that are executed by the at least one processor 12 to provide functions for the one or more modules.

Figure 2:
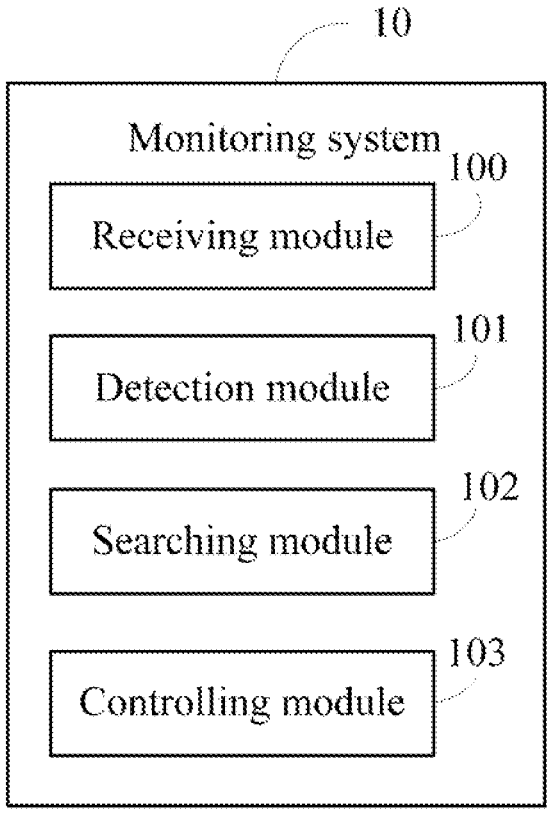
FIG. 2 is block diagram of one embodiment of function modules of the monitoring system in FIG. 1.

As shown in FIG. 2, the monitoring system 10 may include a receiving module 100, a detection module 101, a searching module 102, and a control module 103.

The receiving module 101 receives a color code of each pixel point in an image sent from the infrared camera 2 in sequence, and stores a serial number of each color code. For example, if a resolution of the image is 100 pixels×100 pixels, the serial number of the pixel point located at the top left corner is 1, and the serial number of the pixel point located at the bottom right corner is 10000.

The detection module 102 detects if there are any color codes falling within the color code rang corresponding to the warning temperature range.

If there is a color code falling within the color code range corresponding to the warning temperature range, the searching module 102 determines a location of the pixel point corresponding to the color code. The searching module 102 further determines a block of the monitored area corresponding to the determined locations. For example, the image includes 100 pixels×100 pixels. The monitored area may be divided to 100*100 numbers of blocks. Each pixel of the image is corresponding to each block of the monitored area. If the color code corresponding to the pixel of the serial number "5000" falls within the color code range, the searching module 103 determines the location of the pixel point, and determines the block of the monitored area corresponding to the pixel point.

The control module 103 activates the alarm 3, and controls the LED 4 to point at the determined block.

Figure 3:
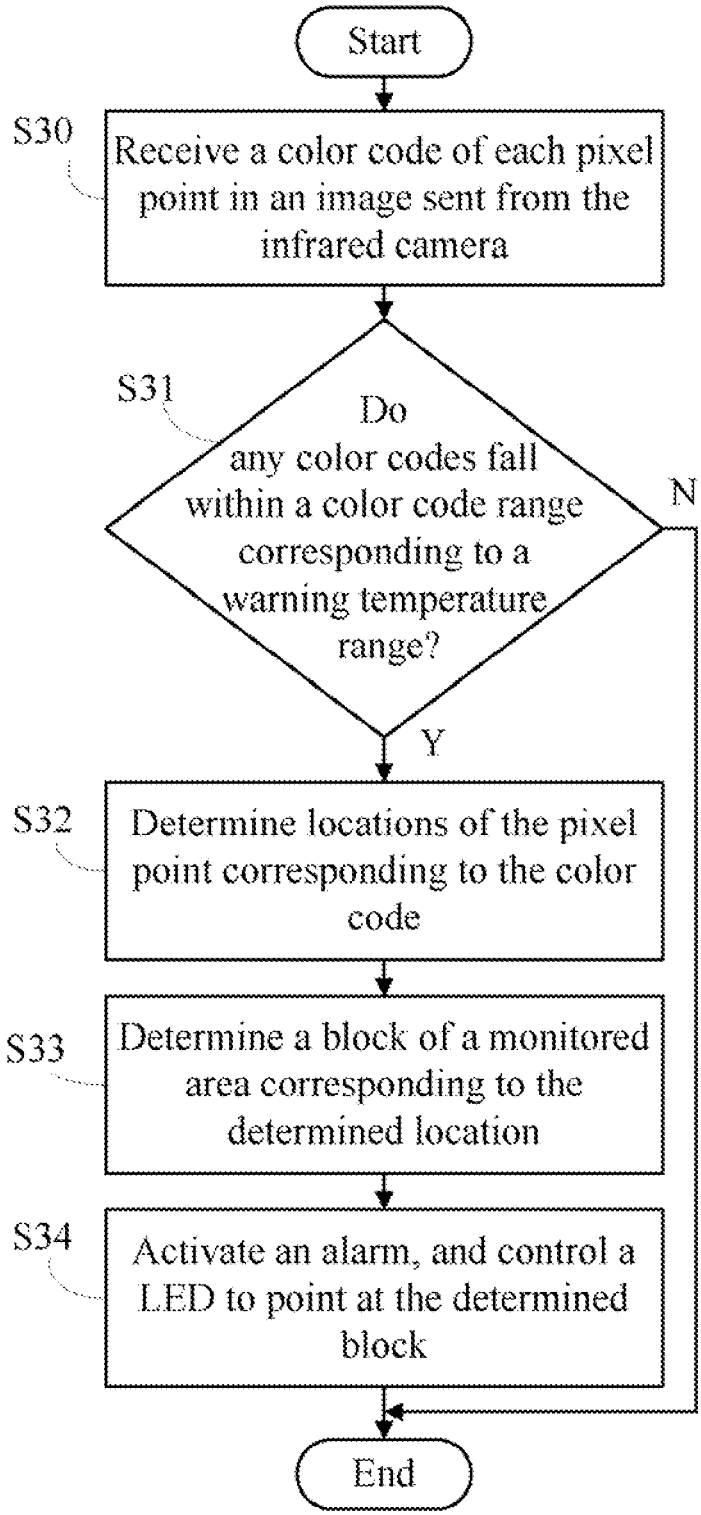
FIG. 3 is flowchart of one embodiment of a temperature monitoring method.

FIG. 3 is a flowchart of one embodiment of a temperature monitoring method. Depending on the embodiment, additional blocks may be added, others removed, and the ordering of the blocks may be changed.

In block S30, the receiving module 101 receives a color code of each pixel point in an image sent from the infrared camera 2 in sequence, and stores a serial number of each color code.

In block S31, the detection module detects if there are any color codes falling within the color code range corresponding to the warning temperature range. If there is a color code falling within the color code range corresponding to the warning temperature range, block S32 is implemented. If there are not any color codes falling within the color corresponding to the warning temperature range, procedures ends.

In block S32, the searching module 102 determines a location of the pixel point corresponding to the color code.

In block S33, the searching module 102 determines a block of the monitored area corresponding to the determined location.

In block S34, the control module 103 activates the alarm 3, and controls the LED 4 to point at the determined block.

Although certain inventive embodiments of the present disclosure have been specifically described, the present disclosure is not to be construed as being limited thereto. Various changes or modifications may be made to the present disclosure without departing from the scope and spirit of the present disclosure.

What is claimed is:

1. A microcontroller, comprising:

a storage system;

at least one processor; and one or more programs being stored in the storage system and executable by the at least one processor, the one or more programs comprising:

a receiving module operable to receive a color code of each pixel point of an image sent from an infrared camera;

a searching module operable to determine a location of a pixel point of the image corresponding to a color code, if the color code falls within a color code range corresponding to a warning temperature range, and determine a block of a monitored area of the image corresponding to the determined location; and a controlling module operable to activate an alarm, and control an LED (light-emitting diode) to point at the determined block.

2. The microcontroller as claimed in claim 1, wherein the infrared camera captures the image, and generate a color code for each pixel point in the image.

3. The microcontroller as claimed in claim 1, wherein the receiving module further stores a serial number of each color code.

4. The microcontroller as claimed in claim 3, wherein the location of the pixel point corresponding to the color code is determined according to the serial number of the color code.

5. The microcontroller as claimed in claim 1, wherein the warning temperature range is a range of temperatures of a human person or an object.

6. A temperature monitoring method, comprising:

receiving a color code of each pixel point in an image sent from an infrared camera;

determining a location of a pixel point of the image corresponding to a color code if the color code falls within a color code rang corresponding to a warning temperature range, and determining a block of a monitored area of the image corresponding to the determined location; and activating an alarm, and controlling an LED (light-emitting diode) to point at the determined block.

7. The method as claimed in claim 6, further comprising:

capturing the image and generating a color code for each pixel point in the image.

8. The method as claimed in claim 6, after block receiving a color code of each pixel point of an image sent from an infrared camera further comprising:

storing a serial number of each color code.

9. The method as claimed in claim 8, wherein the location of the pixel point corresponding to the color code is determined according to the serial number of the color code.

10. The method as claimed in claim 6, wherein the warning temperature range is a range of temperatures of a human person or an object.

11. A non-transitory storage medium storing a set of instructions, the set of instructions capable of being executed by a processor to perform a temperature monitoring method, the method comprising:

receiving a color code of each pixel point in an image sent from an infrared camera;

determining a location of a pixel point of the image corresponding to a color code if the color code falls within a color code rang corresponding to a warning temperature range, and determining a block of a monitored area of the image corresponding to the determined location; and activating an alarm, and controlling an LED (light-emitting diode) to point at the determined block.

12. The medium as claimed in claim 11, further comprising:

capturing the image and generating a color code for each pixel point in the image.

13. The medium as claimed in claim 11, after block receiving a color code of each pixel point of an image sent from an infrared camera further comprising:

storing a serial number of each color code.

14. The medium as claimed in claim 13, wherein the location of the pixel point corresponding to the color code is determined according to the serial number of the color code.

15. The medium as claimed in claim 11, wherein the warning temperature range is a range of temperatures of a human person or an object.

* * * * *